US005263911A

United States Patent [19]

Frydman et al.

[11] Patent Number: 5,263,911

[45] Date of Patent: Nov. 23, 1993

[54] RESISTIVE PROPULSIVE FOOTWEAR

[76] Inventors: Larry G. Frydman, 195 Charles St., Thornhill, Ontario, Canada, L4J 3A2; George Spector, 233 Broadway Rm 702, New York, N.Y. 10279

[21] Appl. No.: 911,520

[22] Filed: Jul. 10, 1992

[51] Int. Cl.[5] ..... A63B 23/08

[52] U.S. Cl. ..... 482/79; 482/124; 482/127; 482/139; 602/26; 128/25 B

[58] Field of Search ..... 482/128, 79, 139, 49, 482/121, 127, 122, 124; 602/26; 128/25 R, 25 B

[56] References Cited

U.S. PATENT DOCUMENTS 4,465,276 8/1984 Cox ..... 482/128

4,623,141 11/1986 Salvino ..... 482/49

4,718,665 1/1988 Airy et al. ..... 482/139

*Primary Examiner*—Richard J. Apley

*Assistant Examiner*—Lynne A. Reichard

[57] ABSTRACT

An exercise device is provided for a joint of a lower limb which consists of a first framework for supporting a first part of the lower limb, a second framework for supporting a second part of the lower limb and a resistive pivot mechanism affixed between the first framework and the second framework, to allow pivotal motion of the frameworks about substantially the same axis as the joint located between the first part and the second part of the lower limb, while providing resistance through a range of the pivotal motion of the joint.

9 Claims, 1 Drawing Sheet

RESISTIVE PROPULSIVE FOOTWEAR

BACKGROUND OF THE INVENTION

The instant invention relates generally to athletic shoes and more specifically it relates to an exercise device for a joint of the lower limb, which provides a resistive pivot mechanism, which will exercise a joint of the lower limb.

There has been a dramatic rise in peoples interest in physical fitness, especially in the past ten years. Health care professionals in general have been recommending aerobic activity, ranging from a full high impact aerobic workout to walking, in order to reduce LDL's specific cholesterol levels), reduction of hypertensive states, improve generalized circulation (cardiac function) and improvement of muscle tone. A significant part of this fitness renaissance has been enveloped within the athletic shoe industry. The trend in the past ten years seemed to lead the athletic shoe industry into high tech, improved performance equipment.

According to electomyographic studies of muscular activity during normal gait, the soleus and gastrocnemius muscles show a large degree of electrical activity. Contraction of this posterior tibial group occurs from the point of heel strike to toe off. The ankle itself is designed to allow twenty degrees of dorsiflexion and fifty degrees of plantar flexion.

There are available various conventional athletic shoes which do not provide the novel improvements of the invention herein disclosed.

SUMMARY OF THE INVENTION

The exercise device contains two key features making it unique: 1) The resistance applied to either (anterior tibial musculature) dorsiflexion or (posterior tibial musculature) plantar flexion is variable. 2) The exercise device may also act variably propulsive These two features provide a combination of both increased muscular activity as well as performance to such tasks as running, jumping, aerobics, walking, etc. When the resistance is applied to the foot moving in dorsiflexion, energy is stored until the foot begins to move into plantar flexion, at which point energy is released and consequently enhances plantar flexion (jumping higher, running faster, etc.). Alternatively, when resistance is applied to the foot moving into plantar flexion, energy is stored until the foot begins to move into dorsiflexion. This in effect increases the workload of the posterior tibial muscles. The compact nature of the exercise device makes it easily incorporated within an athletic shoe, so that a discrete appearance makes this product desirable to the end user.

A primary object of the present invention is to provide an exercise device for a joint of a lower limb that will overcome the shortcomings of the prior art devices.

Another object is to provide an exercise device for a joint of a lower limb that includes a resistive pivot mechanism which will exercise a joint of the lower limb without increasing inferior tension and therefore minimizing any discomfort associated therewith.

An additional object is to provide an exercise device for a joint of a lower limb, that may be constructed as part of an athletic shoe or may be worn separately as an accessory fitness member.

A further object is to provide an exercise device for a joint of a lower limb that is simple and easy to use.

A still further object is to provide an exercise device for a joint of a lower limb that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
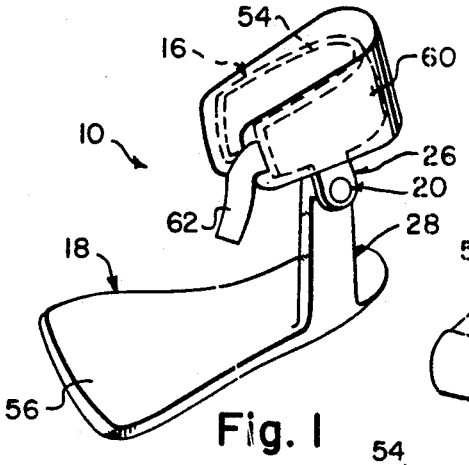
FIG. 1 is a perspective view of the instant invention ready to be placed into an athletic shoe.
Figure 2:
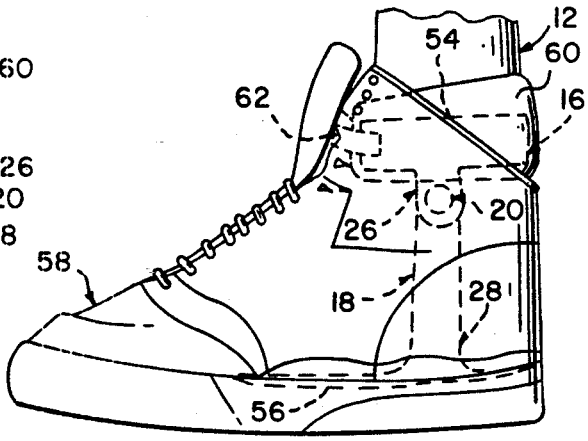
FIG. 2 is a side view of a high top athletic shoe with the instant invention incorporated therein.
Figure 3:
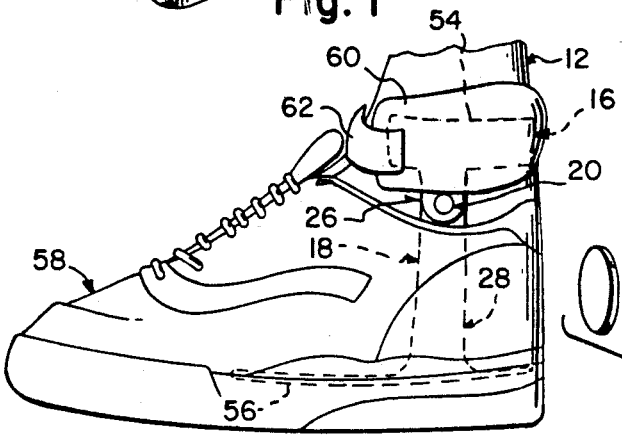
FIG. 3 is a side view of a low cut athletic shoe with the instant invention incorporated therein.
Figure 4:
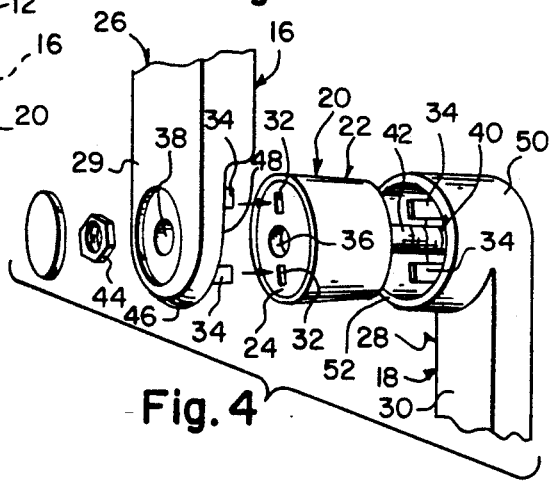
FIG. 4 is an enlarged exploded perspective view showing the resistive pivot mechanism in greater detail.
Figure 5:
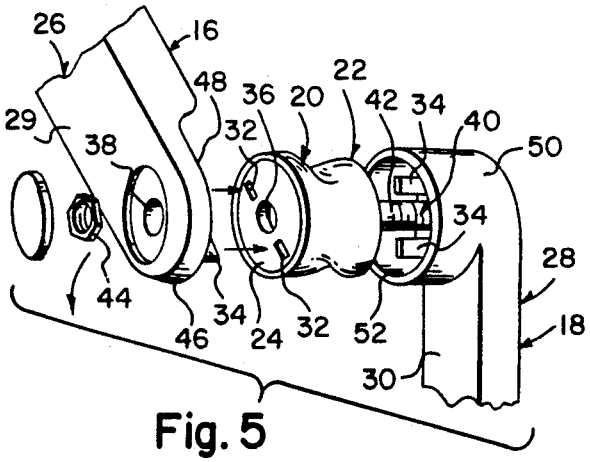
FIG. 5 is an enlarged exploded perspective view similar to FIG. 4, showing the rotation action of the resistive pivot mechanism.

Turning now descriptively to the drawings, in which similar reference characters denote similar elements throughout the several views, the Figures illustrate an exercise device 10 for a joint of a lower limb 12 which consists of a first framework 16 for supporting a first part of the lower limb 12. A second framework 18 for supporting a second part of the lower limb 12.

A resistive pivot mechanism 20 is affixed between the first framework 16 and the second framework 18, to allow pivotal motion of the frameworks 16, 18 about substantially the same axis as the joint located between the first part and the second part of the lower limb 12, while providing resistance through a range of the pivotal motion of the joint. The resistive pivot mechanism 20 is an elastometric cylinder 22 having opposing closed ends 24.

The first framework 16 has a first strut 26 extending in a direction towards the elastometric cylinder 22. The second framework 18 has a second strut 28 extending in a direction towards the elastometric cylinder 22. A distal end 29 of the first strut 24 and a distal end 30 of the second strut are secured to opposite ends 24 of the elastometric cylinder 22.

The elastometric cylinder 22 has a plurality of slots 32 radially spaced about the axis and o the opposing closed ends 24 of the elastometric cylinder 22. The first strut 26 has a plurality of prongs 34 radially spaced about its distal end 29 to fit within the slots 32 in one closed end 24 of the elastometric cylinder 22. The second strut 28 has a plurality of prongs 34 radially spaced about its distal end 30 to fit within the slots 32 in an opposite closed end 24 of the elastometric cylinder 22. The prongs 34 are fixed from rotational movement between the elastometric cylinder 22 and the first and second struts 26, 28.

The elastometric cylinder 22 has central aligned bores 36 through its opposing closed ends 24 at the axis thereof. The first strut 26 has a first central orifice 38 therethrough in its distal end. The second strut 28 has a second central orifice 38 (not shown) therethrough in its distal end 30. A bolt 40 having a threaded shaft 42 extends throuwx0the first central orifice 38 in the first strut 26, the central bores 36 in the elastometric cylinder 22 and the second central orifice 38 in the second strut 30. A hex nut 44 is threadable onto a free end of the threaded bolt 40 to hold the elastometric cylinder 22 between the first strut 26 and the second strut 28 at the axis.

The first strut 26 has a first cylindrical casing 46 with an open side 48 transversely extending from its distal end 29. The second strut 28 has a second cylindrical casing 50 with an open side 52 transversely extending from its distal end 30 so that the first cylindrical casing 46 and the second cylindrical casing 50 will enclose the elastometric cylinder 22. The elastometric cylinder 22 is a shock absorber to provide linear resistance away from the connection of the first and second frameworks 16, 18.

The lower limb 12 is a leg and the first part is a shank, the second part is a foot and the joint is at an ankle. The device 10 further includes the first framework 16 having a curved U-shaped segment 54 on top of the first strut 26 to fit about the shank. The second framework 18 has a flat segment 56 angled perpendicular on bottom of the second strut 28 to fit under the foot, so that the device 10 may be constructed as part of an athletic shoe 58 and may be worn separately as an accessory fitness member.

A padded cover 60 is contoured to fit about the curved U-shaped segment 54 of the first framework 16, in order to reduce any irritation while the device 10 is being worn on the leg. A releasable fastener strap 62 is attached to the curved U-shaped segment 54 to better retain the padded cover 60 to the shank of the leg.

Figure 6:
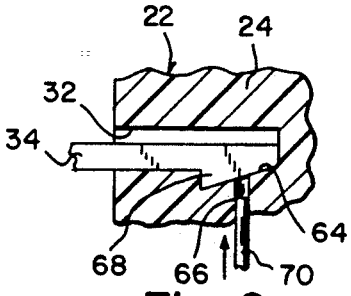
FIG. 6 is a partial cross sectional view showing a modified blade and slot, so that the blade can be retained within the slot until released by a pin.

As shown in FIG. 6, the slots 32 in the elastometric cylinder 22 each have a tapered notched out area 64 and a transverse hole 66 extending from the notched out area 64 to the exterior surface of the elastometric cylinder 22. The prongs 34 on the first and second struts 26, 28 each have a tapered end portion 68 to fit within the tapered notched out area 64 in each slot 32 to better retain the prongs 34 within the slots 32. A pin 70 fits within each transverse hole 66 in the elastometric cylinder 22 to release each prong 34 from each slot 32.

Figure 7:
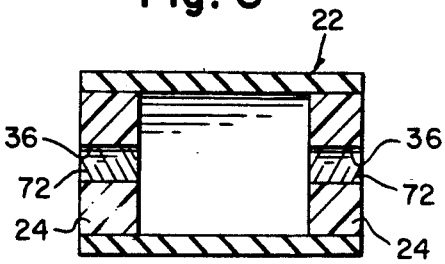
FIG. 7 is a cross sectional view taken along line 4—4 in FIG. 4, showing another modification in which the central bores ar threaded in opposite directions to counteract contraction of the elastometric cylinder thereof.

As shown in FIG. 7, the central bores 36 in the elastometric cylinder 22 are oppositely internally threaded 72 on the threaded shaft 42 of the bolt 40, so as to counteract contraction of the elastometric cylinder 22 during pivotal motion of the joint.

The device 10 may further contain two threaded shafts 42 secured to and projecting from either end 24 of the elastometric cylinder 22, the central orifices 38 being substantially co-axial with the axis and a pair of hex nuts 44, one affixed to each of the shafts 42 on either side of the elastrometric cylinder 22 holding the struts 26, 28 and elastrometirc cylinder 22 together. It may further allow at least one set of slots 32 and prongs 34 to be axially rotated with respect to one another to alter the neutral resting position of the device 10. In addition, the resistance level of the exercise device 10 may be varied by replacing the elastometric cylinder 22 with another of a different resistive level.

Each framework 16, 18 may be formed form a lightweight material, such as polypropylene polycarbonate, aluminum or another suitable alternative. The frameworks 16, 18 can be lined at the points where they contact the lower limb in order to maximize comfort. The lining may be constructed out of a foam or foam like material such as neoprene.

While certain novel feature of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An exercise device for a joint of a lower limb which comprises:
   a) a first framework for supporting a first part of the lower limb;
   b) a second framework for supporting a second part of the lower limb;
   c) a resistive pivot mechanism affixed between said first framework and said second framework, to allow pivotal motion of said frameworks about substantially the same axis as said joint, while providing resistance through a range of the pivotal motion of said joint, wherein said resistive pivot mechanism is an elastometric cylinder having opposing closed ends; further including:
   d) said first framework having a first strut extending in a direction towards said elastometric cylinder;
   e) said second framework having a second strut extending in a direction towards said elastometric cylinder; and
   f) means for securing a distal end of said first strut and a distal end of said second strut to opposite ends of said elastometric cylinder.

2. An exercise device as recited in claim 1, wherein said securing means includes:
   a) said elastometric cylinder having a plurality of slots radially spaced about the axis and on the opposing closed ends of said elastometric cylinder;
   b) said first strut having a plurality of prongs radially spaced about its distal end to fit within said slots in one closed end of said elastometric cylinder; and
   c) said second strut having a plurality of prongs radially spaced about its distal end to fit within said slots in an opposite closed end of said elastometric cylinder, so that said prongs are fixed from rotational movement between said elastometric cylinder and said first and second struts.

3. An exercise device as recited in claim 2, further including:
   a) said elastometric cylinder having central aligned bores through its opposing closed ends at the axis thereof;
   b) said first strut having a first central orifice therethrough in its distal end;
   c) said second strut having a second central orifice therethrough in its distal end;
   d) a bolt having a threaded shaft to extend through said first central orifice in said first strut, said central bores in said elastometric cylinder and said second central orifice in said second strut; and e) a hex nut threadable onto a free end of said threaded bolt to hold said elastometric cylinder between said first strut and said second strut of the axis.

4. An exercise device as recited in claim 3, further including:

a) said first strut having a first cylindrical casing with an open side transversely extending from its distal end; and b) said second strut having a second cylindrical casing with an open side transversely extending from its distal end, so that said first cylindrical casing and said second cylindrical casing will enclose said elastometric cylinder.

5. An exercise device as recited in claim 4, wherein said elastometric cylinder is a rotational shock absorber to provide rotational resistance away from the connection of said first and second frameworks.

6. An exercise device as recited in claim 5, wherein a) said first framework has a curved U-shaped segment on top of said first strut; and b) said second framework has a flat segment angled perpendicularly on the bottom of said second strut adapted to fit in an athletic shoe.

7. An exercise device as recited in claim 6, further including:

a) a padded cover contoured to fit about said curved U-shaped segment of said first framework in order to reduce irritation while said device is being worn on said limb; and b) a releasable fastener strap attached to said curved U-shaped segment to better retain said padded cover on said limb.

8. An exercise device as recited in claim 2, further including:

a) said slots in said elastometric cylinder, each having a tapered notched out area and a transverse hole extending from said notched out area to the exterior surface of said elastometric cylinder;

b) said prongs on said first and second struts each having a tapered end portion to fit within said tapered notched out area in each said slot to better retain said prongs within said slots; and c) a pin to fit within each said transverse hole in said elastometric cylinder to release each said prong from each said slot.

9. An exercise device as recited in claim 8, further including said central bores in said elastometric cylinder being oppositely internally threaded on said threaded shaft of said bolt, so as to counteract contraction of said elastometric cylinder during pivotal motion of the joint.

* * * * *